US006850138B1

(12) United States Patent
Sakai

(10) Patent No.: US 6,850,138 B1
(45) Date of Patent: Feb. 1, 2005

(54) VIBRATION ACTUATOR HAVING AN ELASTIC MEMBER BETWEEN A SUSPENSION PLATE AND A MAGNETIC CIRCUIT DEVICE

(75) Inventor: Nobuyasu Sakai, Sendai (JP)

(73) Assignee: NEC Tokin Corporation, Sendai (JP)

( * ) Notice: Subject to any disclaimer, the term of this patent is extended or adjusted under 35 U.S.C. 154(b) by 363 days.

(21) Appl. No.: 09/869,774

(22) PCT Filed: Dec. 1, 2000

(86) PCT No.: PCT/JP00/08520

§ 371 (c)(1),
(2), (4) Date: Jul. 2, 2001

(87) PCT Pub. No.: WO01/41496

PCT Pub. Date: Jun. 7, 2001

(30) Foreign Application Priority Data

Dec. 2, 1999 (JP) ..... 11-343578

(51) Int. Cl.[7] ..... H01F 7/08

(52) U.S. Cl. ..... 335/222; 340/388.1; 340/388.5; 340/388.6; 381/396; 381/400

(58) Field of Search ..... 340/388.1, 388.3–388.6, 340/391.1, 389.1; 381/396, 400, 412, 420, 433; 335/222

(56) References Cited

U.S. PATENT DOCUMENTS

| | | | | |
|---|---|---|---|---|
| 5,528,697 | A | 6/1996 | Saito | 381/192 |
| 5,894,263 | A | 4/1999 | Shimakawa et al. | 340/388.1 |
| 6,628,798 | B2 * | 9/2003 | Teshima et al. | 381/396 |

FOREIGN PATENT DOCUMENTS

| | | |
|---|---|---|
| EP | 1 063 020 | 12/2000 |
| JP | 58-218296 | 12/1983 |
| JP | 61-18295 | 1/1986 |
| JP | WO 99/39843 | 12/1999 |
| WO | WO 00/52961 | 9/2000 |

* cited by examiner

*Primary Examiner*—Ramon M. Barrera
(74) *Attorney, Agent, or Firm*—Frishauf, Holtz, Goodman & Chick, P.C.

(57) ABSTRACT

A vibration actuator in which a magnetic circuit device (1,2,3) is elastically suspended to a vibration transmitter (12) by a suspension plate (5)in a predetermined direction, a primary elastic member (6*a*) is interposed between the suspension plate and the magnetic circuit device in the predetermined direction. A coil (10) is fixed to a vibrating member (9) and disposed in a magnetic gap of the magnetic circuit. It is preferable that the suspension plate has a leaf spring portion extending along a spiral curve between central and peripheral portions thereof.

26 Claims, 11 Drawing Sheets

VIBRATION ACTUATOR HAVING AN ELASTIC MEMBER BETWEEN A SUSPENSION PLATE AND A MAGNETIC CIRCUIT DEVICE

This application is a U.S. National Phase Application under 35 USC 371 of International Application PCT/JP00/08520 (published in England) filed Dec. 1, 2000.

BACKGROUND OF THE INVENTION

The present invention relates to a vibration actuator which is mainly mounted on mobile communication apparatuses such as a cellular phone, and which has a function of generating a call sound, a voice, and a vibration.

A conventional vibration actuator is disclosed in FIG. 5 of U.S. Pat. No. 5,528,697 issued to Yoshikazu Sato. The conventional vibration actuator comprises a magnet, a pole piece, and a yoke which are coupled with one another to form a magnetic circuit device with a magnetic gap. The magnetic circuit device is elastically suspended to a case or a vibration transmitter by a spring body or a suspension plate in a predetermined direction. A diaphragm is attached as a vibrating member to the case. A coil is fixed to the diaphragm and disposed in the magnetic gap of the magnetic circuit. In the conventional vibration actuator, the magnetic circuit device is directly suspended by only the suspension plate to the vibration transmitter. With this structure, a Q (indicating hereinunder the steepness in mechanical resonance) is great during vibration resonance to narrow a band of the vibration. As a result of narrowing the band, a large resonance positional deviation occurs dependent on use conditions. Accordingly, it is necessary to use a complicated circuit in order to drive the conventional vibration actuator.

SUMMARY OF THE INVENTION

It is therefore an object of the present invention to provide a vibration actuator which suppresses the above-mentioned Q during vibration resonance.

Other objects of the present invention will become clear as the description proceeds.

A vibration actuator to which the present invention is applied includes a magnetic circuit device with a magnetic gap, a vibrating member, a coil fixed to the vibrating member and disposed in the magnetic gap, a vibration transmitter, and a suspension plate for elastically suspending the magnetic circuit device to the vibration transmitter in a predetermined direction. The vibration actuator further comprises a primary elastic member interposed between the suspension plate and the magnetic circuit device in the predetermined direction.

DESCRIPTION OF THE PREFERRED EMBODIMENTS

Figure 1A:
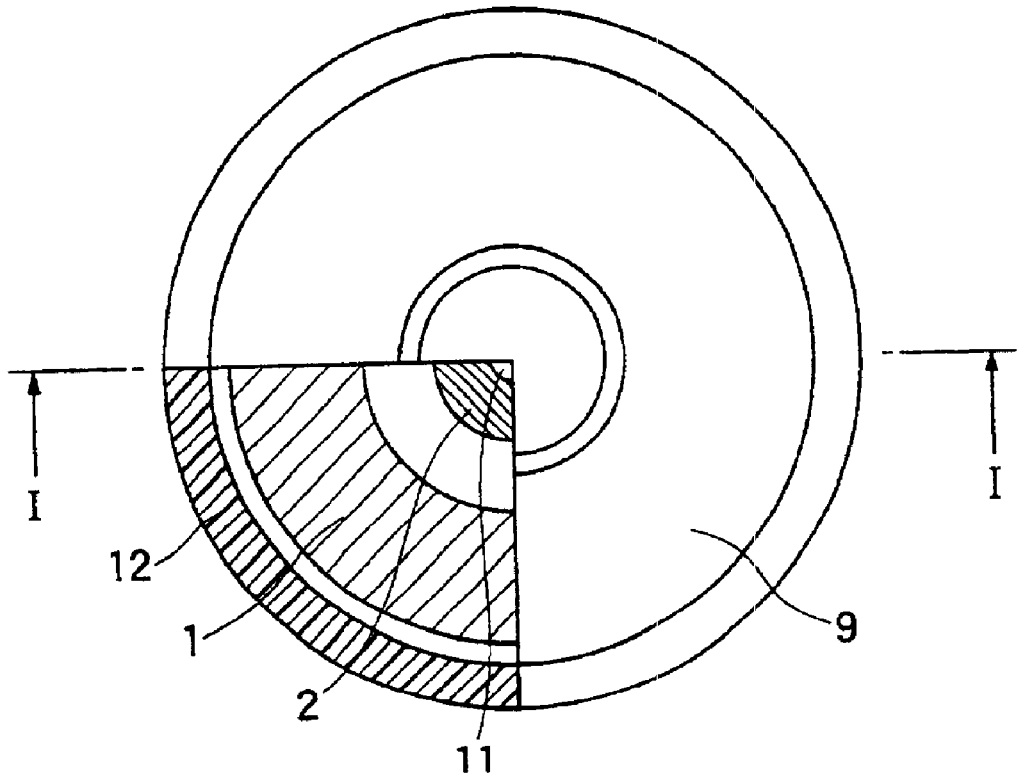
FIG. 1A is a partially cut top view of a vibration actuator according to a first embodiment of the present invention.
Figure 1B:
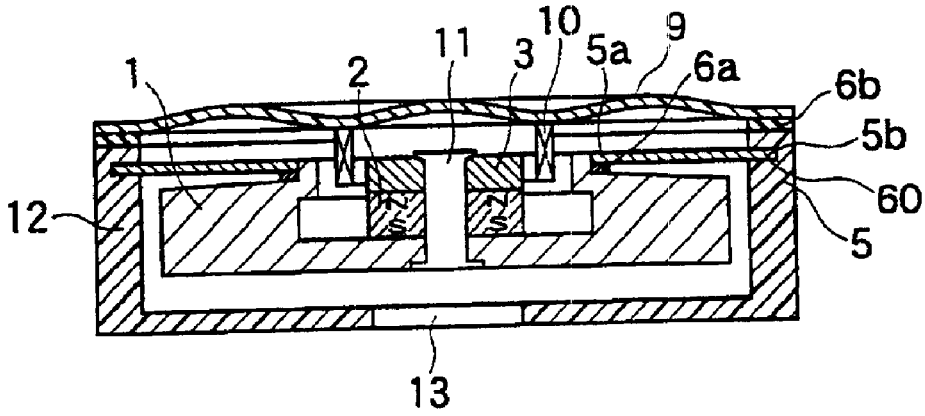
FIG. 1B is a sectional view taken along a line 1—1 of FIG. 1A.

With reference to FIGS. 1A and 1B, description will be made as regards a vibration actuator according to a first embodiment of the present invention.

The vibration actuator of FIGS. 1A and 1B comprises a yoke 1, a disc-shaped permanent magnet 2, a plate 3 which are coupled with one another to form a magnetic circuit device with a magnetic gap in the manner known in the art. The vibration actuator is usually called an internal magnetic type. A central shaft 11 extends In a predetermined direction or a vibration direction and has a part embedded in the recess of the yoke 1. The central shaft 11 is passed and inserted through the central hole of the magnetic circuit device to position the yoke 1, the permanent magnet 2, and the plate 3 on the same axis. The central shaft 11 may has a shape of a bolt, a pin, or the like.

The vibration actuator further comprises a vibrating member 9 of metal, a coil 10 fixed to the vibrating member 9 and disposed in the magnetic gap of the magnetic circuit device, a vibration transmitter 12 made as a single unit of plastic resin, and a suspension plate 5 of metal for elastically suspending the magnetic circuit device to the vibration transmitter 12 in the predetermined direction. The vibration transmitter 12 is cooperated with the vibrating member 9 to surround the magnetic circuit device and therefore serves as a casing.

The suspension plate 5 is constituted of a single piece of circular-arcuate spiral leaf spring which will later become clear. The suspension plate 5 has a central portion 5*a* and a peripheral portion 5*b* around the central portion 5*a*. The central portion 5*a* is connected to a peripheral part of the yoke 1 of the magnetic circuit device via a primary elastic member 6*a* interposed between the suspension plate 5 and the magnetic circuit device in the predetermined direction. The peripheral portion 5*b* is connected to the vibration transmitter 12 via a secondary elastic member or material 60.

The vibrating member 9 has a peripheral portion connected to an upper end of the vibration transmitter 12 via an additional elastic member 6*b*. The coil 10 is positioned at a central portion of the vibrating member 9 and fixed to the vibrating member 9 via an adhesive or the like. Each of the primary and the additional elastic members 8*a* and 8*b* is made of material such as a pressure-sensitive adhesive, bonding agent, and resin. The secondary elastic material may also be made of material such as a pressure sensitive adhesive, bonding agent, and resin.

With the vibration actuator, since the suspension plate 5 is connected to the outer peripheral part of the yoke 1, the vibration of the magnetic circuit device can be suppressed. In addition, a height dimension can be reduced by using the vibrating member 9 of a flat shape.

Here, the tip end of the yoke 1 of the magnetic circuit device is formed in the shape of protrusions, corrugations, or the like so that a high magnetic flux density is easily generated even in the internal magnetic type or an external magnetic type. Moreover, the magnetic pole of the permanent magnet 2 may be directed in either direction.

Used in the suspension plate 5 is a spring material of at least one metal selected from SUS304, SUS301, nickel silver, phosphor bronze and beryllium-copper (Be—Cu) alloy. Additionally, the suspension plate 5 is integrally attached to the vibration transmitter 12 by insert molding, welding, bonding, and the like.

The coil 10 is bonded to the arbitrary position of a radial direction of the vibrating member 9 by an adhesive, and the like. In the vibrating member 9, predetermined acoustic properties can be obtained by the arbitrary plate thickness of the flat shape, disc shape, curved shape, corrugation or combined shape, or by the single curvature or the combination of different curvatures of the curved shape. To obtain a larger amplitude of the vibrating member 9, the outer peripheral part of the vibrating member 9 is fixed to the vibration transmitter 12 via the additional elastic member 6*b*.

The vibration transmitter 12 is formed of resin to bring about an elastic action, and is arbitrarily provided with a sound emitting hole 13 to satisfy the principle of Helmholtz resonator. Here, the joined part of each part of the vibration actuator is hermetically sealed in order to prevent air from flowing in or out via the part other than the sound emitting hole 13.

Figure 2A:
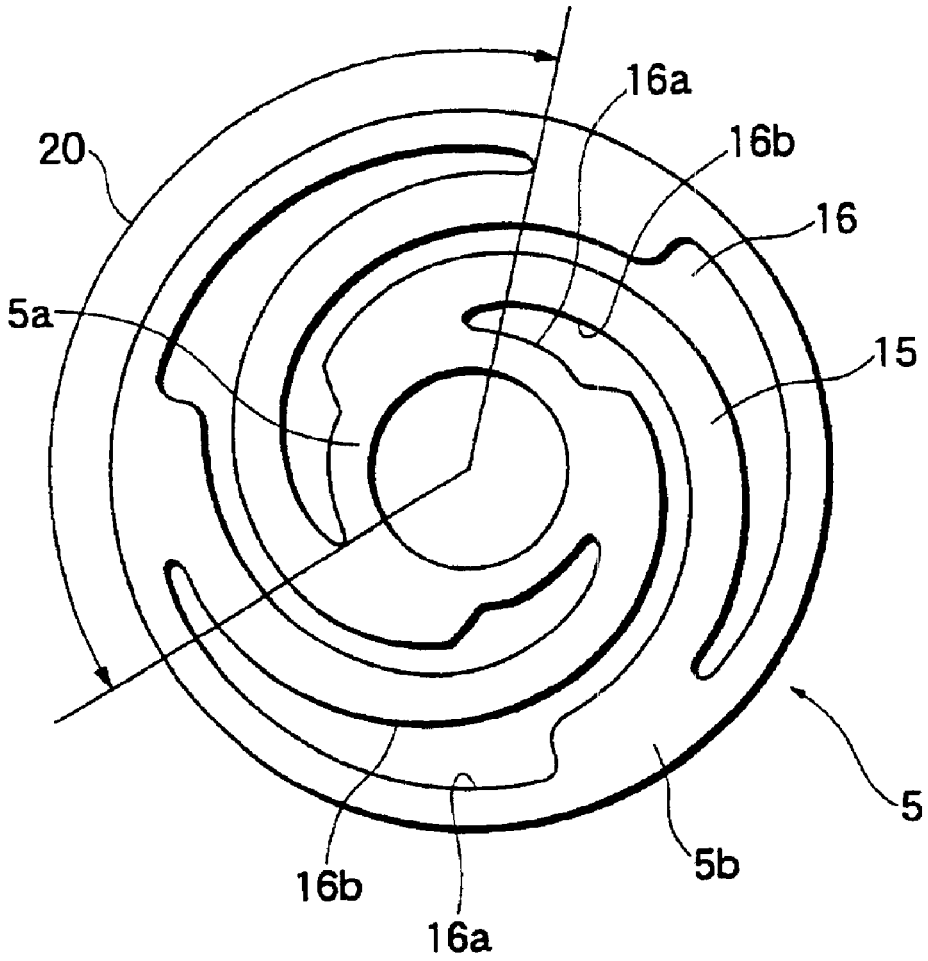
FIG. 2A is a plan view of a suspension plate used in the vibration actuator of FIGS. 1A and 1B.

Referring to FIG. 2A, the suspension plate 5 has three leaf spring portions 15 each extending along a spiral curve between the central and the peripheral portions 5*a* and 5*b*. Each of the leaf springs 15 is formed by two elongated holes 16 extending substantially parallel to the spiral curve. Each of the elongated holes 16 has end areas and an intermediate area between the end areas. The end areas are defined by circular surfaces 16*a* and spiral surfaces 16*b*, respectively. The intermediate area is defined by the spiral surfaces 16*b*. Each of the spiral surfaces 16*b* is parallel to the spiral curve.

More particularly, the suspension plate 5 has a structure in which the surface of the suspension plate 5 is provided with one or a plurality of elongated holes 16 disposed in equal interval positions on a disc. Adjacent ones of the elongated holes 16 overlap with each other on the basis of a central shaft in an angle range of 55 degrees or more. Thus, a spring effective length 20 is lengthened in the suspension spring part 15. Therefore, when external factors such as falling shock are applied in the diametric direction, the magnetic circuit is displaced In the diametric direction, but the rigidity in the diametric direction is small, and no permanent strain remains.

Figure 2B:
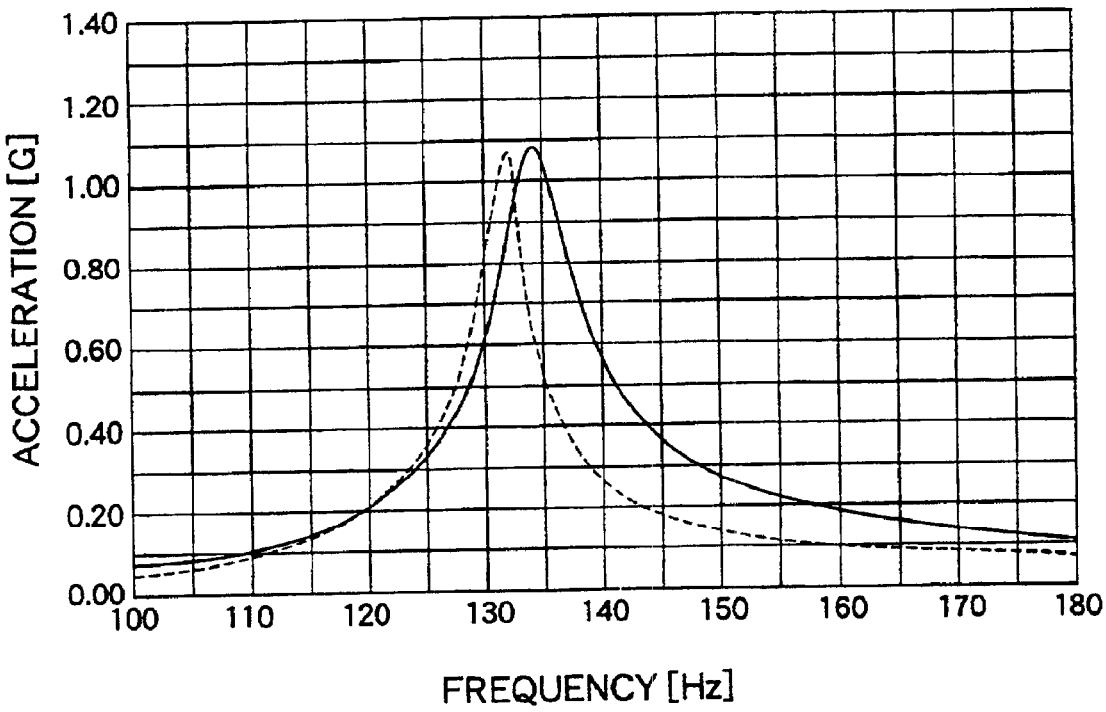
FIG. 2B is a view showing vibration frequency properties, wherein a solid line represents a case using the suspension plate of FIG. 2, a broken line representing a case using a conventional suspension plate.

In FIG. 2B, vibration frequency properties are shown by a solid line and a broken line. The solid line represents a case using the suspension plate of FIG. 2. The broken line represents a case using a conventional suspension plate.

Figure 3A:
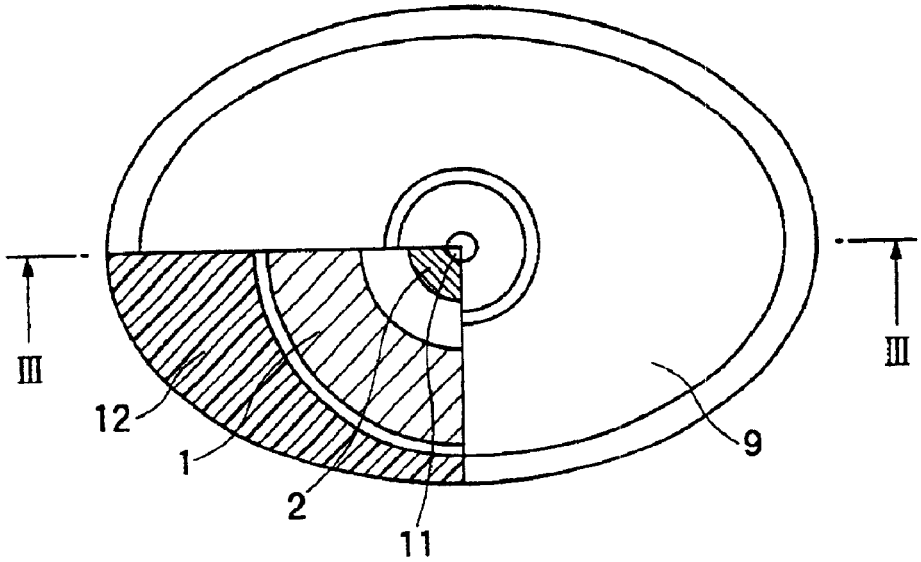
FIG. 3A is a partially cut top view of a vibration actuator according to a second embodiment of the present invention.
Figure 3B:
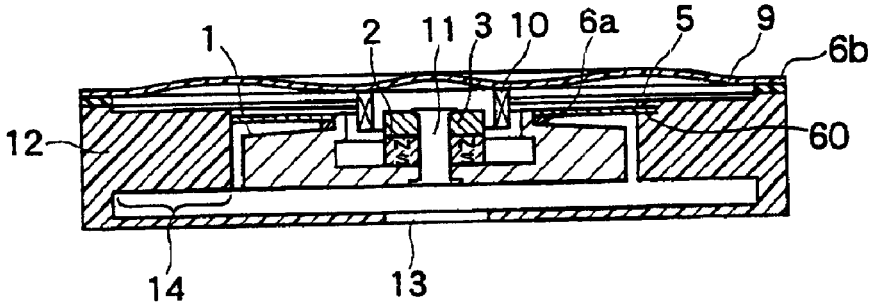
FIG. 3B is a sectional view taken along a line III—III of FIG. 3A.

With reference to FIGS. 3A and 3B, the description will be made as regards a vibration actuator according to a second embodiment of the present invention. The vibration actuator comprises similar parts designated by like reference numerals.

In the vibration actuator of FIGS. 3A and 3B, a vibrator area is enlarged by forming the vibrating member 9 and the vibration transmitter 12 in an elliptical shape to obtain the same degree of sound pressure level as that of the vibration actuator of FIGS. 1A and 1B. With this structure, it is possible to reduce the area of a housing attachment part and to avoid a drop of sound pressure level caused by the area reduction.

In addition, a corrugated stopper 14 is disposed on the inner peripheral part of the vibration transmitter 12 for adjusting an interval or space between the magnetic circuit device and the vibration transmitter 12 to prevent the magnetic circuit device from being exceedingly displaced in the radial direction. It is to be noted that this construction enables the interval or space to be constant.

Figure 3C:
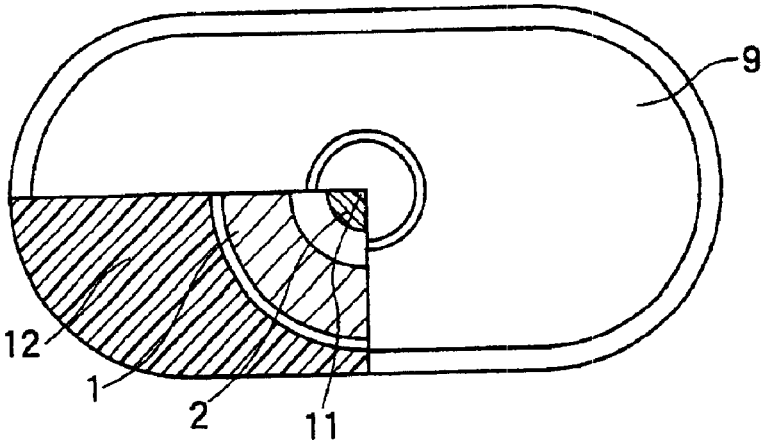
FIG. 3C is a partially cut top view showing a modification of the vibration actuator illustrated in FIGS. 3A and 3B.

With reference to FIG. 3C, the description will be made as regards a modification of the vibration actuator illustrated in FIGS. 3A and 3B. The vibration actuator comprises similar parts designated by like reference numerals. The vibrating member 9 and the vibration transmitter 12 may be formed in an elongated circular shape as shown in FIG. 3C.

In each of the vibration actuators of FIGS. 3A–3C the yoke 1 and/or the suspension plate 5 may be formed to have a shape similar to that of the vibration member 9 in their top views. With this arrangement, it is possible to design the yoke 1 to have greater mass. In a case using the yoke 1 of the greater mass, the vibration actuator can cause the vibration of a greater level.

Figure 4:
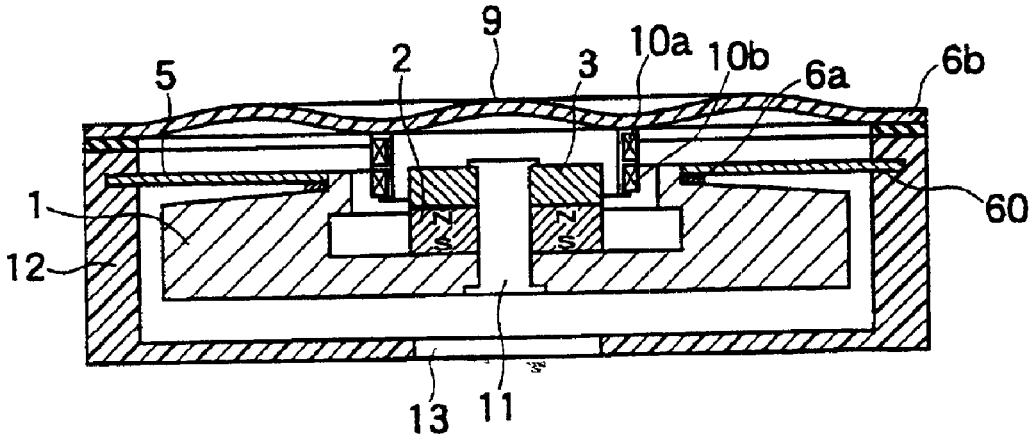
FIG. 4 is a sectional view of a vibration actuator according to a third embodiment of the present Invention.

With reference to FIG. 4, the description will be made as regards a vibration actuator according to a third embodiment of the present invention. The vibration actuator comprises similar parts designated by like reference numerals. In the vibration actuator of FIG. 4, the coil 10 is divided into a plurality of pieces or coils 10*a* and 10*b* arranged in the predetermined direction. When the coils 10*a* and 10*b* or the magnetic circuit device vibrates, a strong magnetic flux is always applied to either one coil.

Figure 5:
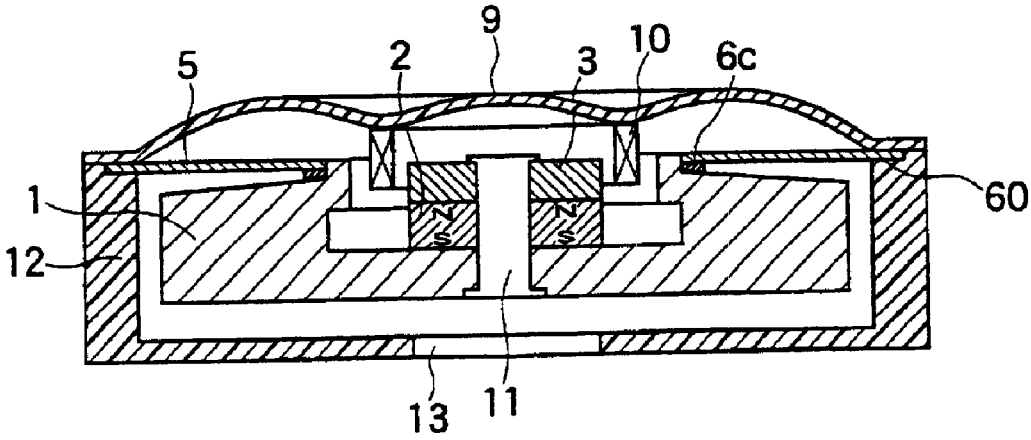
FIG. 5 is a sectional view of a vibration actuator according to a fourth embodiment of the present invention.

With reference to FIG. 5, the description will be made as regards a vibration actuator according to a fourth embodiment of the present Invention. The vibration actuator comprises similar parts designated by like reference numerals. In the vibration actuator of FIG. 5, the outer peripheral part of the vibrating member 9 is bonded to the outer peripheral part of the suspension plate 5 with the adhesive or the like without interposing any elastic material. With this structure, the height dimension and volume of the vibration actuator can be reduced.

Figure 6:
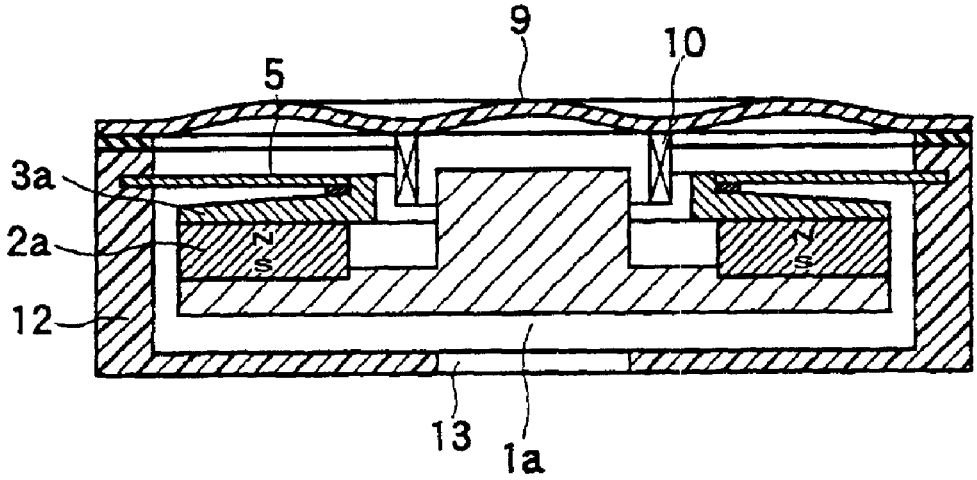
FIG. 6 is a sectional view of a vibration actuator according to a fifth embodiment of the present invention.

With reference to FIG. 6, the description will be made as regards a vibration actuator according to a fifth embodiment of the present invention. The vibration actuator comprises similar parts designated by like reference numerals. In the vibration actuator of FIG. 6, the magnetic circuit device in the vibration actuator is changed to that of the external magnetic type. A donut-shaped permanent magnet 2*a* is held and inserted between the corrugated groove formed in the outer peripheral part of the yoke 1 and a plate 3*a* via the adhesive or the like, and coaxially positioned.

Figure 7:
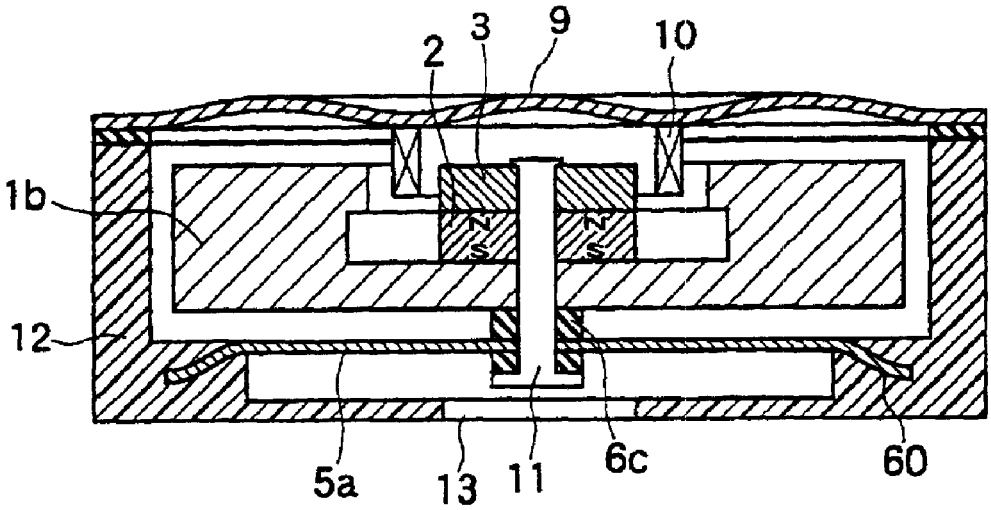
FIG. 7 is a sectional view of a vibration actuator according to a sixth embodiment of the present invention.

With reference to FIG. 7, the description will be made as regards a vibration actuator according to a sixth embodiment of the present invention. The vibration actuator comprises similar parts designated by like reference numerals. The vibration actuator of FIG. 7 is of the internal magnetic type. The central shaft 11 is passed and inserted through the central hole of a suspension plate 5*a* and magnetic circuit device while the central part of the suspension plate 5*a* is held via an elastic member 6*c*. The magnetic circuit device, the suspension plate 5*a*, and the vibration transmitter 12 are positioned on the same axis by the central shaft 11. It is to be noted that the suspension plate 5*a* corresponds to the suspension plate 5 in FIGS. 1A and 1B and that the elastic member 6*c* corresponds to the primary elastic member 6*a* in FIGS. 1A and 1B.

Figure 8:
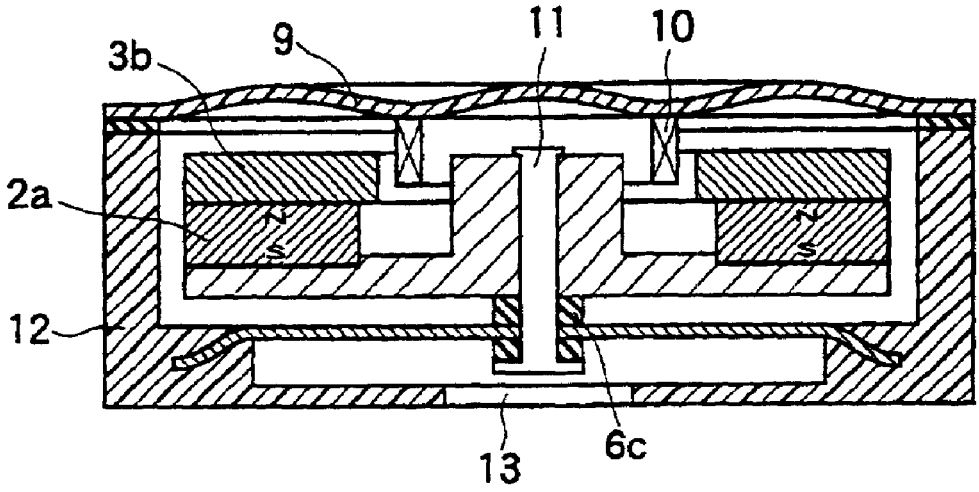
FIG. 8 is a sectional view of a vibration actuator according to a seventh embodiment of the present invention.

With reference to FIG. 8, the description will be made as regards a vibration actuator according to a seventh embodiment of the present invention. The vibration actuator comprises similar parts designated by like reference numerals. In the vibration actuator of FIG. 8, the magnetic circuit device of the vibration actuator of FIG. 7 is changed to that of the external magnetic type. In addition, a radial structure is used in consideration of a countermeasure against a leak magnetic flux. Here, similarly to the vibration actuator illustrated in FIG. 6, the donut-shaped permanent magnet 2*a* is held and embedded in the corrugated groove formed in the outer peripheral part of a yoke 1*c* and a plate 3*b* via the adhesive or the like, and positioned on the same axis. It is to be noted that the magnetization of the donut-shaped permanent magnet 2*a* is in a thickness direction.

Figure 9:
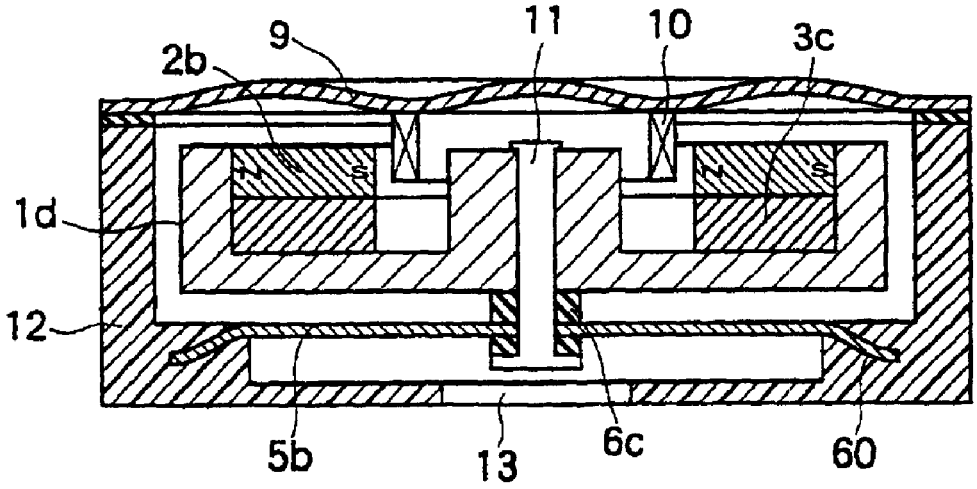
FIG. 9 is a sectional view of a vibration actuator according to an eighth embodiment of the present invention.

With reference to FIG. 9, the description will be made as regards a vibration actuator according to an eighth embodiment of the present invention. The vibration actuator comprises similar parts designated by like reference numerals. In the vibration actuator of FIG. 9, the magnetic circuit device is changed to that of high magnetic flux density structure. In addition, the radial structure is used in consideration of the countermeasure against the leak magnetic flux. Similarly to FIG. 5, a donut-shaped permanent magnet 2*b* is held between and fixed to the outer peripheral part of the yoke and a plate 3*c* of the resin or the like via the adhesive or the like, and coaxially positioned. It is to be noted that the magnetization of the donut-shaped permanent magnet 2*b* is in a circumferential direction.

Figure 10:
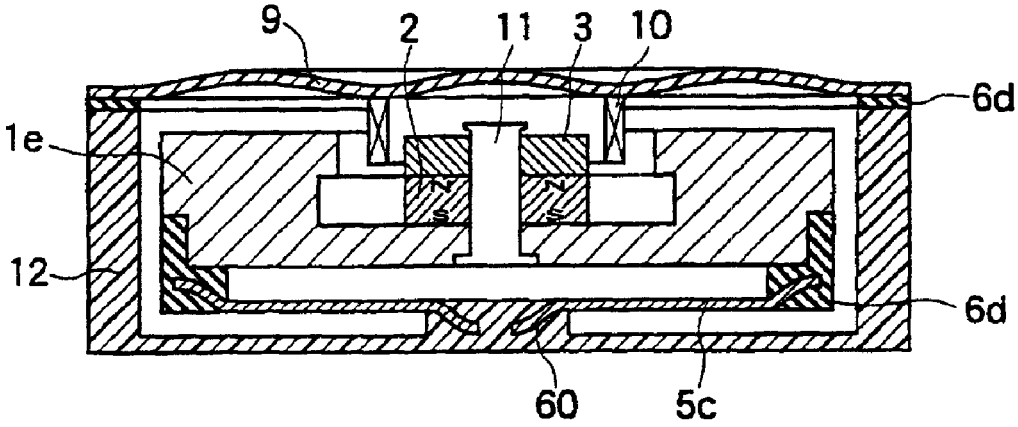
FIG. 10 is a sectional view of a vibration actuator according to a ninth embodiment of the present invention.

With reference to FIG. 10, the description will be made as regards a vibration actuator according to a ninth embodiment of the present invention. The vibration actuator comprises similar parts designated by like reference numerals.

The vibration actuator of FIG. 10 is of the internal magnetic type in that the outer peripheral part of a yoke 1*e* of the magnetic circuit is flexibly supported by a suspension plate 5*c* via an elastic material 6*d*. While the similar support structure is used, the magnetic circuit device may be that of the external magnetic type or the radial type. Moreover, similarly to FIG. 1, by fixing the suspension plate 5*c* to the outer peripheral part of the yoke 1*e*, the vibration of the magnetic circuit device can effectively be suppressed. It is to be noted that the suspension plate 5*c* corresponds to the suspension plate 5 in FIGS. 1A and 1B and that the elastic member 6*c* corresponds to the primary elastic member 6*d* in FIGS. 1A and 1B.

When a drive current is supplied to the coil 10, the magnetic circuit device and the vibrating member 9 vibrates together with the coil 10 in the predetermined direction in the manner known in the art. In this event, the vibrating member 9 produces a vibration having a large amplitude. This is because, the vibration member 9 has arbitrary material, shape, plate thickness, and the like and attached via the elastic member 6*d* of the pressure-sensitive adhesive, bonding agent or resin. The vibration of the vibrating member 9 is transmitted to air. Therefore, the acoustic properties with a high sound pressure level and of a wide band can be obtained. Moreover, inasmuch as the elastic material 6*d* is used between the respective members, the Q during resonance can be suppressed.

In this case, the vibration transmitter 12 forms the fixed part in the low frequency or forms the elastic material in the high frequency, and vibrates as a part of the vibrator 9. The magnetic circuit device and the vibrating member 9 interfere with each other to operate in each of the vibration and acoustic modes. Moreover, since the members other than the magnetic circuit device, the coil 10, and the central shaft 11 bring about the elastic action, the performance deterioration by the abnormal stresses such as the falling shock can be reduced.

Figure 11:
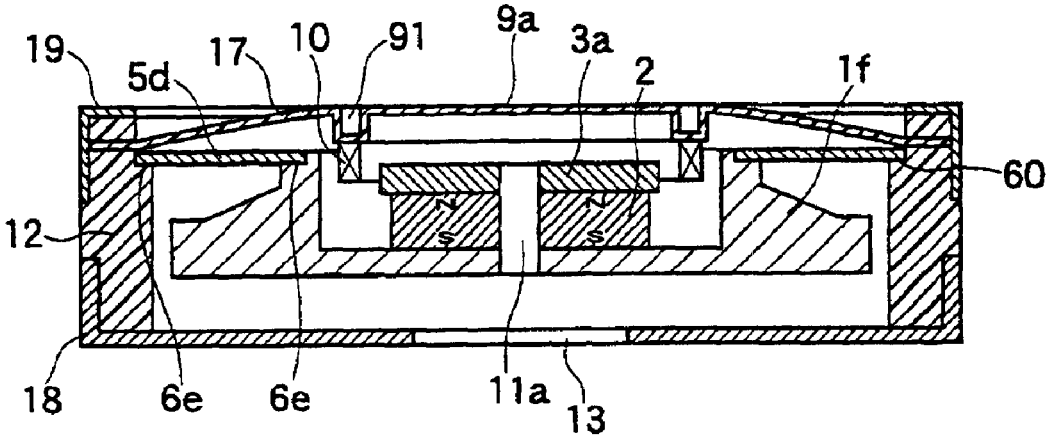
FIG. 11 is a sectional view of a vibration actuator according to a tenth embodiment of the present invention.

With reference to FIG. 11, the description will be made as regards a vibration actuator according to a tenth embodiment of the present invention. The vibration actuator comprises similar parts designated by like reference numerals.

In the vibration actuator of FIG. 11, the magnetic circuit device is of the internal magnetic type similar to that of the vibration actuator shown in FIGS. 1A and 1B, but separately the external magnetic type, or the radial type may be used. A suspension plate 5*d* is fixed to the magnetic circuit device via an elastic material or member 6*e* and to the vibration transmitter 12 via the secondary elastic member 60. The elastic material or member 6*e* is of the pressure sensitive adhesive, bonding agent, resin, or the like. It is to be noted that the suspension plate 5*d* corresponds to the suspension plate 5 in FIGS. 1A and 1B and that the elastic material or member 6*e* corresponds to the primary elastic member 6*a* in FIGS. 1A and 1B.

A vibrating plate 9*a* corresponding to the vibrating plate 9 in FIGS. 1A and 1B has a corrugated part 91 in order to increase the amplitude of the vibrating plate 9*a* during the positioning and driving of the coil 10. The adhesive or the like to a portion corresponding to the corrugated part 91 fixes the coil 10.

Moreover, the vibrating plate 9*a* has a spring part 17 fixed to the vibration transmitter 12 by the elastic material 6*e* such as the bonding agent, pressure-sensitive adhesive, or the like, and fixed by a support frame 19 via the elastic material 6*e*. In this case, a protective plate 18 provided with an arbitrary hole is attached to the outer peripheral part of the vibration transmitter 12 in order to protect the functional main body of the vibration actuator.

Figure 12A:
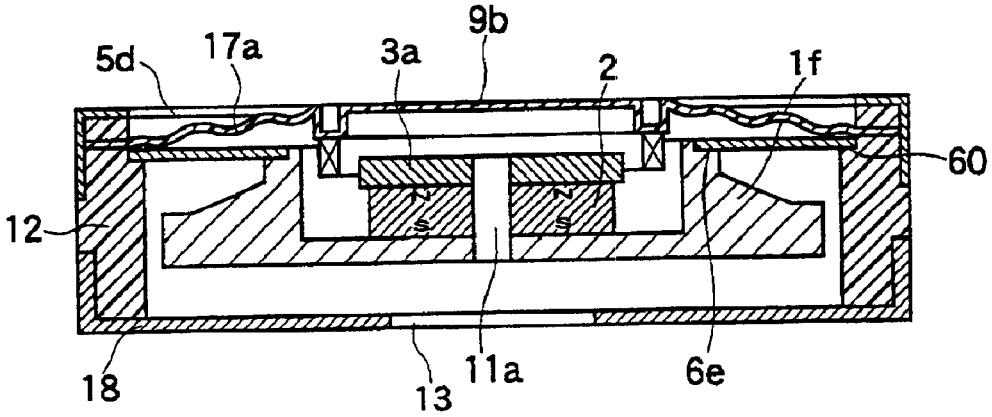
FIG. 12A is a sectional view of a vibration actuator according to an eleventh embodiment of the present invention, wherein a vibrating member has a corrugation.

With reference to FIG. 12A, the description will be made as regards a vibration actuator according to an eleventh embodiment of the present invention. The vibration actuator comprises similar parts designated by like reference numerals. In the vibration actuator of FIG. 12, the corrugation is applied in an outer peripheral spring part 17*a* of a vibrating member 9*b*. With the vibration actuator, a normal operation and a large amplitude are brought about to allow air to vibrate without any positional deviation of the vibrator 9*b* during the driving, as compared with the vibration actuator illustrated in FIG. 11. Therefore, the high sound pressure level, and acoustic properties with low noises are obtained. Furthermore, by arbitrarily changing the material, shape, plate thickness, and the like of the vibrator 9*b* or the spring part 17*a*, the frequency properties of a wide band can be obtained.

Figure 12B:
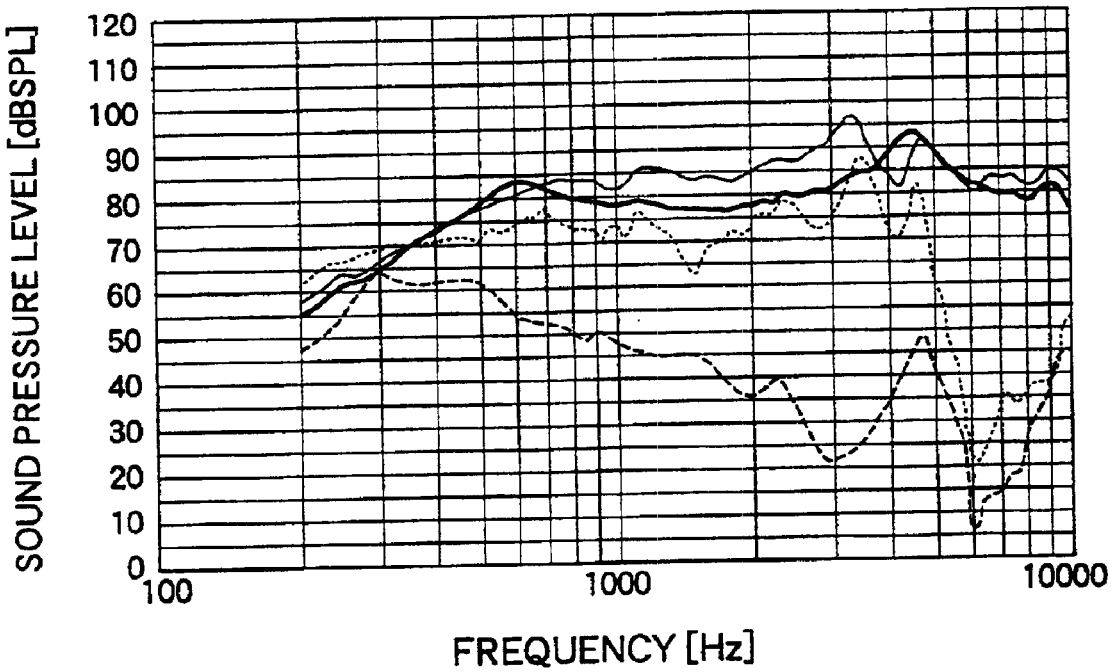
FIG. 12B is a view showing a typical example of acoustic properties of the vibration actuator of FIG. 12A and a conventional vibration actuator in which a vibrating member does not have a corrugation, wherein a thick solid-line represents a basic wave property in the vibration actuator of FIG. 12A, a thick broken-line representing a distortion property in the vibration actuator of FIG. 12A, a thin solid-line representing the basic wave property In the conventional vibration actuator, a thin broken-line representing the distortion property in the conventional vibration actuator.

In FIG. 12B, a typical example of acoustic properties is shown as regards the vibration actuator of FIG. 12A and a conventional vibration actuator in which a vibrating member does not have a corrugation. A thick solid-line represents a basic wave property in the vibration actuator of FIG. 12A. A thick broken-line represents a distortion property in the vibration actuator of FIG. 12A. A thin solid-line represents the basic wave property in the conventional vibration actuator. A thin broken-line represents the distortion property in the conventional vibration actuator. As will be understood from FIG. 12B, the basic wave property in the vibration actuator of FIG. 12A is flat in a wide-band frequency rather than that in the conventional vibration actuator. In addition, the vibration actuator of FIG. 12A enables to obtain a frequency property of a low noise of 10% or less in a high-band frequency of 500 Hz or more.

Figure 13:
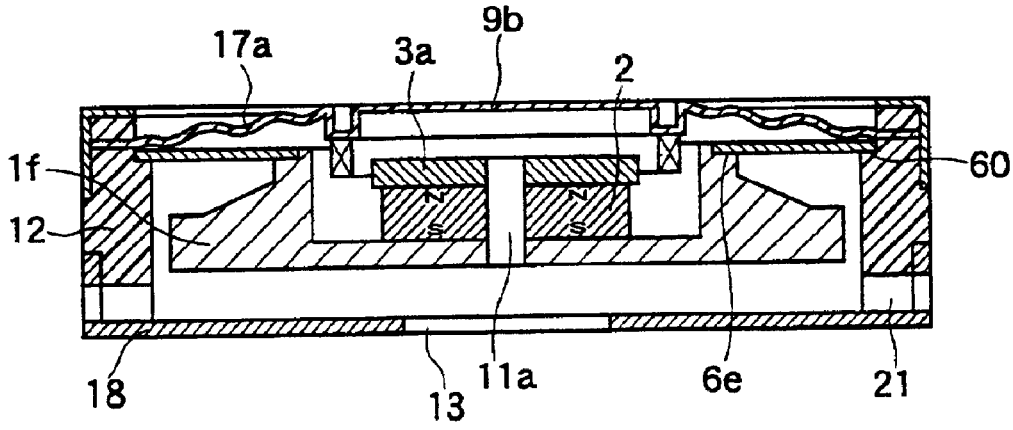
FIG. 13 is a sectional view of a vibration actuator according to a twelfth embodiment of the present Invention.

With reference to FIG. 13, the description will be made as regards a vibration actuator according to a twelfth embodiment of the present invention. The vibration actuator comprises similar parts designated by like reference numerals. In the vibration actuator of FIG. 13, the vibration transmitter 12 is provided with a plurality of leak holes 21. Each of the leak holes 21 is of a circular shape, a polygonal shape, or other arbitrary shape. With the vibration actuator, a sound pressure of 10 to 30 dB is attenuated so that the properties can be controlled.

Figure 14:
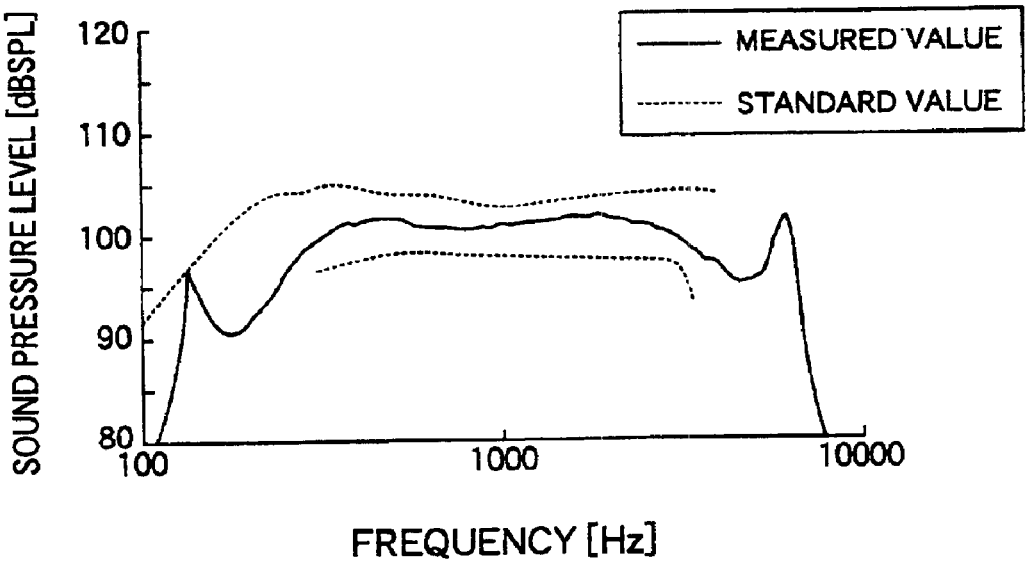
FIG. 14 is a view showing a typical example of acoustic properties of the vibration actuator illustrated in FIG. 13.

With reference to FIG. 14, the description will be directed to a typical example of acoustic properties of the vibration actuator illustrated in FIG. 13. A solid line of FIG. 14 indicates measured value, two dotted lines indicating a range of standard value. Flat frequency properties can be realized in a frequency band of the order of 300 to 3,000 Hz which sufficiently satisfies the standard value of IEC318 and IEC711.

Figure 15:
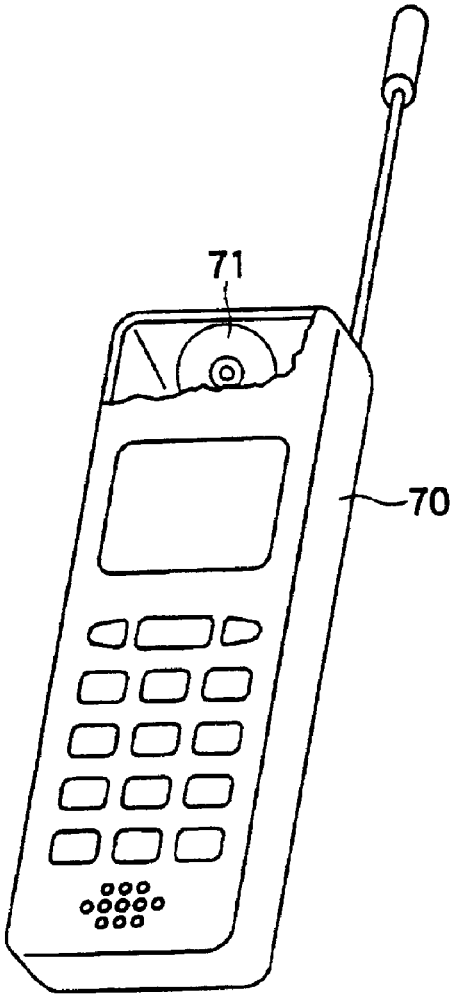
FIG. 15 is a partially broken perspective view of a cellular phone having a vibration actuator of a circular shape.

Referring to FIG. 15, a cellular phone 70 is provided with a vibration actuator 71 according to an example of the present invention. The vibration actuator 71 has an outline of a circular shape.

Figure 16:
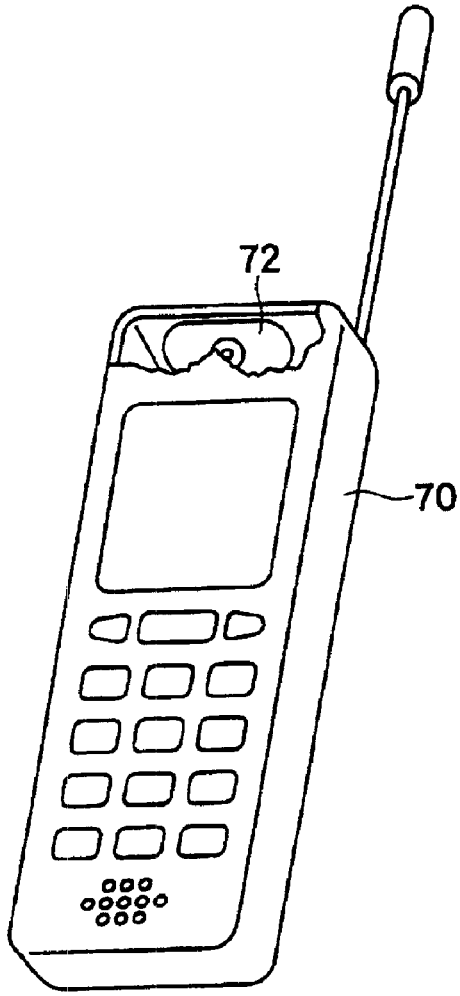
FIG. 16 is a partially broken perspective view of a cellular phone having a vibration actuator of an elongated circular shape.

Referring to FIG. 16, a cellular phone 70 is provided with a vibration actuator 72 according to another example of the present invention. The vibration actuator 72 has an outline of an elongated circular shape. The outline of the vibration actuator 72 may be modified to have an elliptical shape.

Thus, by forming the vibrating member, the vibration transmitter, and the like in the circular, the elliptic, and the elongated circular shapes, there can be provided the vibration actuator in which the components can be attached to the housing in accordance with the housing attachment area and shape. The vibration can constantly be transmitted to the outside with a constant efficiency even when the shaped is changed.

The vibrating member is formed by a film member made of plastic material selected from PEI (polyetherimide), PET (polyethylene terephthalate), PC (polycarbonate), PPS (polyphenylenesulfide), PAR(polyarylate), PI (polyimide), and PPTA (poly-p-phenylene terephthalamide (Aramid)).

What is claimed is:

1. A vibration actuator including a magnetic circuit device with a magnetic gap, a vibrating member, a coil fixed to said vibrating member and disposed in said magnetic gap, a vibration transmitter, and a suspension plate for elastically suspending said magnetic circuit device to said vibration transmitter in a predetermined direction, said vibration actuator further comprising a primary elastic member interposed between said suspension plate and said magnetic circuit device in said predetermined direction, wherein said suspension plate has a central portion and a peripheral portion around said central portion, said peripheral portion being connected to said vibration transmitter, said central portion being connected to said magnetic circuit device through said primary elastic member, and wherein said suspension plate includes a leaf spring portion extending along a spiral curve between said central and said peripheral portions.

2. A vibration actuator as claimed in claim 1, wherein said suspension plate has a plurality of elongated holes which extends substantially parallel to said spiral curve to form said leaf spring portion therebetween.

3. A vibration actuator as claimed in claim 2, wherein each of said elongated holes has end areas and an intermediate area between said end areas, each of said end areas being defined by a circular surface and a spiral surface which is parallel to said spiral curve, said intermediate area being defined by opposite spiral surfaces which are parallel to said spiral curve.

4. A vibration actuator as claimed in claim 1, wherein said suspension plate is made of at least one spring material selected from SUS304, SUS301, nickel silver, phosphor bronze, and beryllium-copper (BeCu) alloy.

5. A vibration actuator as claimed in claim 1, wherein said magnetic circuit has any one of an internal magnetic type, an external magnetic type, and a radial type.

6. A vibration actuator as claimed in claim 1, wherein each of said vibrating member and said vibration transmitter has a shape selected from a circular shape, an elliptic shape, and an elongated circular shape.

7. A vibration actuator as claimed in claim 1, wherein said vibrating member has a shape selected from a flat plate shape, a disc shape, a curved shape, a corrugation, and a combination of said respective shapes.

8. A vibration actuator as claimed in claim 1, further comprising a connecting member connecting one of central and peripheral parts of said magnetic circuit device to a central part of said suspension plate.

9. A vibration actuator as claimed in claim 8, wherein said primary elastic member is fixed between said suspension plate and said connecting member.

10. A vibration actuator as claimed in claim 1, wherein said suspension plate has a central opening, said magnetic circuit device being fitted in said central opening and fixed to said suspension plate.

11. A vibration actuator as claimed in claim 10, wherein said primary elastic member is fixed between said suspension plate and said magnetic circuit device.

12. A vibration actuator as claimed in claim 1, wherein said coil is fixed to a particular position of said vibrating member by an adhesive.

13. A vibration actuator as claimed in claim 1, wherein said vibration transmitter has at least one sound emitting hole.

14. A vibration actuator as claimed in claim 13, wherein said at least one sound emitting hole makes said vibration transmitter serve as a Helmholtz resonator.

15. A vibration actuator as claimed in claim 1, wherein said magnetic circuit device includes a yoke having at least one protrusion adjacent to said magnetic gap.

16. A vibration actuator as claimed in claim 1, further comprising a secondary elastic member fixed between said suspension plate and said vibration transmitter in said predetermined direction.

17. A vibration actuator as claimed in claim 1, wherein said suspension plate and said vibration transmitter are integrally formed by means selected from insert molding, bonding, and welding.

18. A vibration actuator as claimed in claim 1, further comprising a stopper disposed inside said vibration transmitter for adjusting a space between said magnetic circuit device and said vibration transmitter.

19. A vibration actuator as claimed in claim 1, wherein said vibrating member has a part fixed to said suspension plate.

20. A vibration actuator as claimed in claim 1, wherein said vibration transmitter vibrates together with said vibrator when said coil is supplied with a current of a high frequency.

21. A vibration actuator as claimed in claim 1, wherein said vibration transmitter forms a fixed part in a low frequency, and forms an elastic material in the high frequency.

22. A vibration actuator as claimed in claim 1, wherein said vibration transmitter has at least one leak hole for decreasing sound pressure.

23. A vibration actuator as claimed in claim 1, wherein said coil is divided into a plurality of pieces.

24. A vibration actuator as claimed in claim 1, wherein said vibrating member is formed by a film member made of plastic material selected from polyetherimide, polyethylene terephthalate, polycarbonate, polyphenylene-sulfide, polyarylate, polyimide, and poly-p-phenylene terephthalamide (Aramid).

25. A vibration actuator, including a magnetic circuit device with a magnetic gap, a vibrating member, a coil fixed to said vibrating member and disposed in said magnetic gap, a vibration transmitter, and a suspension plate for elastically suspending said magnetic circuit device to said vibration transmitter in a predetermined direction, said vibration actuator further comprising a primary elastic member interposed between said suspension plate and said magnetic circuit device in said predetermined direction, and an additional elastic member fixed between said vibrating member and said vibration transmitter in said predetermined direction.

26. A vibration actuator as claimed in claim 25, wherein said suspension plate has a central portion and a peripheral portion around said central portion, said peripheral portion being connected to said vibration transmitter, said central portion being connected to said magnetic circuit device through said primary elastic member.

* * * * *